US005495894A

United States Patent [19]

Späth

[11] Patent Number: 5,495,894

[45] **Date of Patent: * Mar. 5, 1996**

[54] FIRE PROTECTION FILTER

[76] Inventor: Michael M. Späth, Lindwurmstr. 10/VII, D-8000 Munich 2, Germany

[ * ] Notice: The portion of the term of this patent subsequent to Mar. 27, 2010, has been disclaimed.

[21] Appl. No.: 458,712

[22] PCT Filed: Jun. 6, 1989

[86] PCT No.: PCT/EP89/00633

§ 371 Date: Sep. 27, 1993

§ 102(e) Date: Sep. 27, 1993

[30] Foreign Application Priority Data

Jun. 6, 1988 [DE] Germany ..... 38 19 258.6

[51] Int. Cl.[6] ..... A62C 4/00

[52] U.S. Cl. ..... 169/48; 48/192

[58] Field of Search ..... 169/45, 48, 54; 454/257, 258, 357; 48/192; 52/317

[56] References Cited

U.S. PATENT DOCUMENTS 2,420,599 5/1947 Jurs ..... 48/192

FOREIGN PATENT DOCUMENTS 2052683 5/1972 Germany ..... 169/48

1448175 12/1988 U.S.S.R. ..... 169/48

*Primary Examiner*—Andrew C. Pike

*Attorney, Agent, or Firm*—Dykema Gossett

[57] ABSTRACT

A firebreak for ventilation ducts comprises at least one package of parallel fireproofing plates made of a material that expands strongly when exposed to heat, the plates being oriented in the direction of flow in the ventilation duct, with the package filling the cross section of the ventilation duct. To prevent the flames from breaking through and/or to prevent deflagrations into the next fire control sector during the expanding material's reaction time, at least one insert that fills the cross section of the ventilation duct is disposed in the vicinity of the package, said insert being filled of expanded material that is a strongly thermally conductive material.

12 Claims, 1 Drawing Sheet

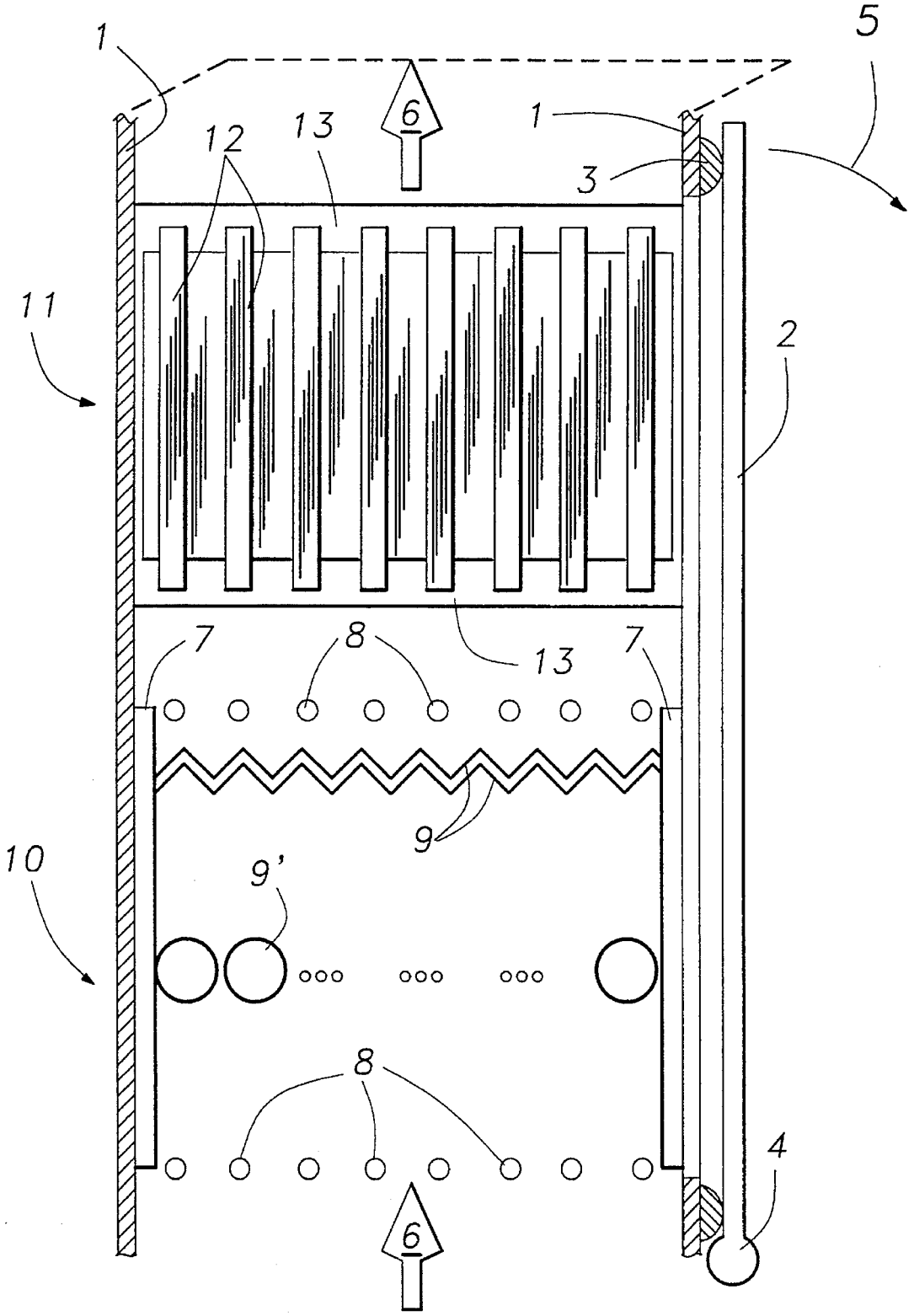
1
5
6
1
12
13
3
11
2
7
8
13
7
9
10
9'
8
4
6

FIRE PROTECTION FILTER

A comprehensive system of air intake and exhaust channels must be installed nowadays in major building complexes, e.g., hospitals, industrial buildings, office buildings, apartment complexes, and underground garages, but also in tunnels and shelters. The main runs in particular of such ventilation systems penetrate fire control sectors and thus facilitate quite considerably the spread of a blaze in the event of fire. To prevent this, devices are installed in ventilation systems of this type at the boundaries between fire control sectors, which devices are activated in case of fire to seal the ventilation system at these junctures.

These may be mechanical dampers or bulkheads, or they may be closures of another type, such as, for example, the so-called fireproofing plates that have the property of expanding to a multiple of their original volume when exposed to the effects of high heat (e.g., from about 80° C. on up). A large number of these plates, parallel to each other, are installed in a cross section of the air intake or exhaust ducts by means of a frame, holder, or other suitable structures, in such a way that the planes of the plates coincide will or lie parallel to the direction of flow. In this manner, air can continue to flow through between the plates unhindered when they are in their original condition, thus when their thickness is small. In case of fire or other occasion of heat, on the other hand, these fireproofing plates expand so strongly that they contact each other and even fuse, thus leading to complete interruption of the flow cross section.

Such ventilation duct closures do have the advantage that their mechanical functioning need not be checked at regular intervals, but on the other hand have disadvantages: among them, that these fireproofing plates do not expand until a relatively high threshold temperature upwards of 80° C. (as a rule, 150° C.), and, furthermore, that once this threshold temperature has been reached it takes several minutes for the material to expand to its fullest extent. It can therefore happen, especially in the case of rapidly spreading fires, that, for example, after the threshold temperature has been attained at the closure, the flame front advances on this closure so rapidly that the flame front, for example a flame vortex, has already passed or broken through this closure before the fireproofing plate has expanded completely, thus after the reaction time necessary to seal off the closure has passed. In this case such a closure would be ineffective until the seal were complete, since the flame front would have been able to pass to the next fire control sector prior to establishment of the final seal.

It is therefore the object of the present invention to improve, in such a way that the flames are prevented from breaking through and/or a deflagration is prevented into the next fire control sector, a closure of the type described, said closure consisting of a material that expands strongly under the effect of heat.

To attain this object, it is proposed that fine-meshed lattices one or more layers thick and consisting of material with good thermal conductivity be placed in the cross section of the ventilation ducts in addition to the fireproofing plates. Since good thermal conductivity is afforded primarily by metals, such lattices are known by the name expanded metal in various thicknesses; for example, expanded metal packages consisting of metal foil only a few 1/100 mm thick, or tanks onto which such an expanded metal is added by processing, are used for explosion protection in containers holding flammable and highly volatile liquids.

Especially when a large number of expanded metal layers is placed in sequence in the direction of flow in the ventilation ducts, even such a .small thickness is enough to prevent breakthrough of the flames, at least for the time required for the closure to seal off completely. It is herewith obviously recommended that the individual layers of expanded metal be disposed transverse to the direction of flow in the ventilation ducts in order to ensure a sideways flow of heat, hence to the walls of the ventilation duct. A large number of such expanded metal layers is especially advisable when there is reason to fear that any fires occurring will exhibit such a steep temperature gradient over a small spatial distance that the first layer of expanded metal exposed to the source of the fire will already have melted and thus become ineffective while the layers away from the source of the fire will remain fully functioning with regard to their thermal conduction.

Obviously, it would also be possible to use so-called filling particles in place of a large number of layers of expanded metal, most of which particles are spherical in shape and are made of expanded metal, thus having only small mass and a large number of small hollow spaces; the possibly greater resistance offered to flow by such a particle filling compared to the package of layered expanded metal of the same thickness must be taken into consideration. Depending on the application, a combination of layered expanded metal and the aforesaid filling particles can also be preferable.

In both cases, it is advantageous that the individual layers of expanded metal be disposed in a frame or that the filling particles be disposed in a type of cage consisting of a fairly massive lattice, so that this insert can be removed as a whole from the cross section of the ventilation duct. This is necessary, for one thing, because the filling in this insert, regardless of whether it consists of individual layers of expanded metal or of filling particles, also has an air filtering function, and thus will foul, so that cleaning and/or replacement is necessary from time to time. Two individual lattices, lodged transversely in the cross section of the duct, could also be used in place of the frame, so that the expanded material is inserted after the first lattice is lodged. This is, to be sure, disadvantageous with respect to maintenance, but in exchange, the heat is conducted by the expanded metal directly to the wall of the duct without a detour through the sides of the frame.

Depending on the type of structure and/or the type of fire to be expected, one or more such inserts could be disposed in the cross section of the ventilation duct in front of and/or behind, in the direction of flow in the duct, the fireproofing plates, or one such insert can even be employed between two closures consisting of fireproofing plates. Expanded material and fireproofing plates can also be housed in a common space.

Depending on the type of duct to be protected, either the expanded metal insert, or the fireproofing plate package, or both can be embodied in such a way that they completely fill the cross section of the uninterrupted duct, or in such a way that the duct is completely interrupted for an appropriate distance, with the inserts and/or packages deployed in this break and then have a cross section larger than that of the duct to be protected. In this case, however, it is more difficult to seal off the cross section of the channel from the surroundings than if the one or more inserts and packages were inserted directly into the ventilation duct cross section.

Another consideration regarding the type of sequential arrangement of metal filled inserts and fireproofing plate packages is that an arrangement with metal filled inserts placed ahead of the fireproofing plates does equalize the temperature over the cross section of the ventilation duct, which is valuable for uniform operation of the fireproofing plates, but on the other hand, due to the initial strong conduction of heat, the temperature of the air flowing along the fireproofing plates is reduced so much for a certain amount of time that they do not begin to expand until much later compared to an arrangement with the insert behind the fireproofing plates as viewed in the direction of flow in the duct.

On the other hand, an arrangement with the metal filled insert in front of the fireproofing plates has the advantage that the insert filled with expanded metal retains its filtering effect, which has the result that this metal filled insert is the first to become fouled in normal operation, with the fireproofing plates behind it remaining relatively cleaner. This provides two advantages. First, the fireproofing plates are thermally insulated from contamination by a very thick layer, which contamination otherwise results in the fireproofing plates responding too late in case of need. Second, these plates need only be cleaned seldomly, if at all, in normal. operation. This means an economic advantage, since the fireproofing plates need to be kept watertight, and thus are coated with an appropriate thin coating. In the case of frequent cleaning, a large part of the fireproofing plates are damaged by the cleaning process, so that regular replacement of these fireproofing plates would be required for safety reasons.

An exemplary embodiment of the invention is explained in greater detail below.

The Figure shows a longitudinal section through a ventilation duct whose wall is designated 1 and whose, e.g., rectangular cross section is indicated by the broken lines, This duct has air or another gas flowing through it, as shown by the direction of flow 6.

Disposed within the wall 1 of this ventilation duct, in order by direction of flow, are both an insert 10 filled with expanded metal and a package 11 filled with fireproofing plates in such a way that both the insert 10 and the package 11 completely fill the inside cross section of the wall 1 as far as possible. Although only one insert 10 is illustrated, a series of inserts 10 can be employed. For example, one insert 10 can be in from of package 11 (below the package according to the illustration) and/or an insert 10 can be placed behind package 11 (i.e., above package 11 according to the drawing).

In the case shown here, both the insert 10 and the package 11 can both be inserted through an opening in the wall 1 of the ventilation duct transverse to the direction of flow, which opening is closed by a door 2 when the ventilation duct is in normal operation. This door 2 is articulated to the wall 1 by means of a hinge 4 and when closed is held tightly compressed against the wall 1 by a latch mechanism (not shown) with a peripheral seal 3 disposed between the wall 1 and the edge of door 2 in order to isolate the interior of the ventilation duct from the surroundings. Obviously, fireproofing plates and expanded material can also enter the ventilation duct by another route.

The package 11 comprises in known manner a holder 13 into which the individual fireproofing plates 12 can be inserted so that a compact package 11 results that is placed in the cross section of the ventilation duct. Only the narrow edges of the fireproofing plates 12 in package 11 thus opposes the flowing air over the vast majority of the clear cross section of the ventilation duct, while the holder 13 slightly impedes the flow through the ventilation duct at the periphery of the clear cross section.

Viewed in the direction of flow 6, the insert 10, which contains individual layers 9 of expanded metal, is ahead of the package 11 with the fireproofing plates 12. The layers 9 preferably are made of aluminum and are preferably a few hundredths of a millimeter thick. As an alternative embodiment, spherical filler particles 9' are employed, either as a substitute for layers 9 or in combination. This insert 10 comprises sides 7, which form a closed profile conjugate with the interior contour of the ventilation duct. These sides 7 are supplemented by transverse reinforcements 8 running transverse to the direction of flow 6 in the ventilation duct, said reinforcements holding the layers 9 of expanded metal in their position transverse to the direction of flow 6 and preventing these layers from buckling, which would inevitably cause the edges of these layers 9 to make defective contact with the sides 7 of the insert 10 and thus with the wall 1 of the ventilation duct, causing severe degradation of the thermal flux to the outside, In FIG. 1, only two of the successive layers 9 of expanded metal within the insert 10 are shown, but in practice this insert 10, and hence the free space between the two layers of transverse reinforcements 8, is completely filled with overlying layers 9 of expanded metal that are intended to contact each other at as many points as possible. Similarly, filler particles 9' would completely fill insert 10.

For cleaning or replacement of this expanded metal, the entire insert 10 is removed from the ventilation duct with the door 2 open. One layer of transverse reinforcements 8 is embodied so that it can be removed from the sides 7, so that after removal of these transverse reinforcements the layers 9 of expanded metal can be removed from the insert 10 with no problem, then cleaned or replaced.

I claim:

1. Fire control closure for a ventilation duct, said fire control closure having at least one package of fireproofing plates consisting of a material that expands strongly under heat, said package being oriented in a direction of flow in the ventilation duct and filling a cross section of the ventilation duct, wherein at least one insert that fills the cross section of the ventilation duct is disposed near the package, said insert being filled with expanding material that is strongly heat conducting material.

2. Fire control closure according to claim 1, wherein the expanding material of said insert is expanding metal.

3. Fire control closure according to claim 2, wherein the expanding metal consists of aluminum foil at least two hundredths of a millimeter thick.

4. Fire control closure according to claim 2, wherein the insert is filled with a multiplicity of layers of said expanding material thereof oriented transverse to the direction of flow in the ventilation duct.

5. Fire control closure according to claim 1, wherein the insert is filled with generally spherical filling particles made of said expanding material of said insert.

6. Fire control closure according to claim 5, wherein the insert further comprises transversely oriented layers made of said expanding material thereof.

7. Fire control closure according to claim 1, wherein the insert comprises sides running parallel to walls of the ventilation duct and two layers having a plurality of transverse reinforcements, respectively, said layers being oriented transverse to the direction of flow in the ventilation duct, further comprising spherical filler particles made of said expanding material of said insert, said filler particles each having a diameter and being disposed between said two layers, and wherein spacing of any two neighboring said transverse reinforcements is considerably smaller than said diameter of said filler particles.

8. Fire control closure according to claim 1, wherein the insert comprises transverse reinforcements in the form of two transversely oriented meshes anchored in the cross section of the ventilation duct, such that said expanding material of said insert is disposed between said meshes.

9. Fire control closure according to claim 8, wherein the meshes are anchored by lodging in the cross section of the ventilation duct.

10. Fire control closure according to claim 1, wherein said at least one insert is disposed in front of said at least one package, viewed in the direction of flow in the ventilation duct.

11. Fire control closure according to claim 1, wherein removal from the ventilation duct of the insert and the package is uncomplicated.

12. Fire control closure according to claim 11, wherein a wall of the ventilation duct has a door through which the insert and the package can be inserted into or removed from the ventilation duct.

* * * * *